United States Patent [19]

Isozumi

[11] Patent Number: 5,014,563

[45] Date of Patent: May 14, 1991

[54] ENGINE STARTER MOTOR

[75] Inventor: Shuzoo Isozumi, Himeji City, Japan

[73] Assignee: Mitsubishi Denki Kabushiki Kaisha, Tokyo, Japan

[21] Appl. No.: 410,569

[22] Filed: Sep. 21, 1989

[30] Foreign Application Priority Data

| | | | |
|---|---|---|---|
| Sep. 21, 1988 | [JP] | Japan | 63-237110 |
| Sep. 27, 1988 | [JP] | Japan | 63-126662[U] |
| Sep. 27, 1988 | [JP] | Japan | 63-126663[U] |

[51] Int. Cl.[5] ..... F02N 15/06

[52] U.S. Cl. ..... 74/7 R; 74/7 C; 192/42

[58] Field of Search ..... 74/6, 7 R, 7C; 290/38 C, 48; 192/42

[56] References Cited

U.S. PATENT DOCUMENTS

| | | | |
|---|---|---|---|
| 3,630,092 | 12/1971 | Matsumoto | 74/7 R |
| 3,656,355 | 4/1972 | Matsumoto | 74/7 B |
| 3,690,188 | 9/1972 | McMillen | 74/7 R |
| 4,347,442 | 8/1982 | White et al. | 290/48 |
| 4,613,761 | 9/1986 | Yabunaka | 290/36 R |
| 4,800,766 | 1/1989 | Isozumi et al. | 74/7 E |
| 4,838,100 | 6/1989 | Tanaka | 74/7 R X |
| 4,855,610 | 8/1989 | Morishita et al. | 290/48 |

FOREIGN PATENT DOCUMENTS

| | | | |
|---|---|---|---|
| 54-138926 | 10/1979 | Japan | 74/7 R |
| 56-107957 | 8/1981 | Japan . | |
| 62-195455 | 8/1987 | Japan | 290/48 |

*Primary Examiner*—Allan D. Herrmann

*Attorney, Agent, or Firm*—Sughrue, Mion, Zinn, Macpeak and Seas

[57] ABSTRACT

An inertia sliding type engine starter motor, wherein an inner member 24*b* of an over-running clutch rotatable with an armature rotary shaft is axially forwardly immovably supported by a bearing 28 mounted to a front housing 22. The clutch inner member has helical splines 29 formed in its inner circumference, the pinion 30 is axially slidably mounted on the rotary shaft, and a rotational force is transmitted from the clutch inner member to the pinion through the helical splines. The pinion has formed at its rear portion a flange 30*d* having an outer diameter larger than a diameter of an opening in the front end of the front housing. The front end of the clutch inner member and the rear end surface of the pinion abut with each other when the pinion is disengaged with an engine ring gear, and the armature rotary shaft in front of the pinion is covered by a cover 34.

2 Claims, 4 Drawing Sheets

ENGINE STARTER MOTOR

BACKGROUND OF THE INVENTION

This invention relates to an engine starter motor and more particularly to an inertia sliding type starter motor in which the pinion slides along the shaft by inertia upon the rotation of the electric motor.

One example of the conventional inertia sliding type engine starter motor as shown in FIG. 6 is disclosed in Japanese Utility Model Laid-Open No. 56-107957. In FIG. 6, the engine starter motor comprises an over-running clutch 4 and a pinion 5 slidably mounted on the shaft 3 of an armature rotary shaft 2 extending from an electric motor 1. The over-running clutch 4 comprises a clutch outer member 4*a* having, teeth formed in the inner circumference of its boss which engage helical splines 6 formed in the shaft 3. The pinion 5 is formed integrally with a clutch inner member 4*b* and is slidably supported on the shaft 3 by a sleeve bearing 7 fitted on its inner circumferential surface. The armature rotary shaft 2 is supported by bearing 14 mounted to a front housing 15.

In FIG. 6, reference numeral 8 is an engine ring gear, 9 is a stopper secured to the end portion of the shaft 3, 10 is a return spring disposed between the stopper 9 and the pinion 5, and M is a power supply terminal for supplying electric power to the electric motor 1.

The operation of the conventional starter motor will now be described.

Referring to the circuit diagram shown in FIG. 7, when a key switch 11 of a vehicle is turned on, an electric current flows through a switch coil 13*a* of a solenoid switch 13 from a battery 12, causing a plunger 13*b* of the solenoid switch 13 to be repelled to bring a movable contact 13*c* into engagement with stationary contacts 13*d* and 13*e*, to thereby close the normally-open contacts. As a result, electrical power from the battery 12 is applied to the supply terminal M of the electric motor 1 and an electric current flows through a filed coil 1*a* and an armature coil 1*b* to cause the armature 1*b* to rotate. At this time, the over-running clutch 4 and the pinion 5 integral therewith slide forward (to the right in FIG. 6) because of the inclination of the helical splines 6 formed on the shaft 3 and the inertia of the over-running clutch 4 and the like against the return spring 10, whereby the pinion 5 meshes with the ring gear 8 to start the engine.

When the key switch 11 is turned off, the movable contact 13*c* separates from the stationary contacts 13*d* and 13*e* and returns to its original position due to a contact spring (not shown), whereby the power supply to the electric motor 1 is terminated and at the same time the pinion 5 together with the over-running clutch 4 is returned to the stationary position shown in FIG. 6 by compression force of the return spring 10.

The conventional engine starter motor of the above construction is disadvantageous in the following points:

(a) Since the pinion 5 is integrally formed with the clutch inner member 4*b* of the over-running clutch 4, the over-running clutch 4 also moves when the pinion 5 is moved to start the engine. Therefore, the mechanical impact exerted on the ring gear 8 from the pinion 5 during the initial stage of the meshing is large, so that the pinion 5 and/or the ring gear 8 can be damaged.

(b) Since the distance between the pinion 5 and the bearing 14 mounted to the front housing 15 is long, the armature rotary shaft 2 has a cantilevered structure, and a large bending moment is generated at the armature rotary shaft which may cause its bending or destruction.

(c) Since water splash may enter inside of the starter motor in the direction shown by an arrow in FIG. 6 because the pinion 5 and the sliding surfaces therefor are exposed, the shaft 3 may generate rust impeding smooth sliding movement of the pinion 5, and the return spring 10 may generate rust resulting in breakage. Also, the water which has entered through the gap between the clutch inner member 4*a* of the over-running clutch 4 and the front housing 15 may reach into the electric motor through the gap between the bearing 14 supporting the armature rotary shaft 2 and the armature rotary shaft 2, resulting in malfunctioning of the electric motor. This takes place particularly easily when, as in outboard engines or industrial engines, the crank shaft is in a vertical position, the flywheel is mounted in a horizontal position, and the starter motor is vertically installed with the pinion positioned at the top of it.

SUMMARY OF THE INVENTION

Accordingly, one object of the present invention is to provide an engine starter motor free the above discussed disadvantages of the conventional starter motor.

Another object of the present invention is to provide an engine starter motor in which the mechanical shock exerted on the engine ring gear by the starter pinion at the initial stage of is engagement is reduced, whereby damages to the ring gear and the pinion can be prevented.

Another object of the present invention is to provide an engine starter motor in which rusting in the armature rotary shaft tip portion is prevented, thereby to prevent malfunctioning of the starter.

With the above objects in view, according to the inertia sliding type engine starter motor of the present invention, a clutch inner member of an over-running clutch rotatable with an armature shaft which is coupled to an inner member of the over-running clutch through rollers is axially forwardly immovably supported by a bearing mounted to a front housing, the clutch inner member has helical splines formed in its inner circumference, the pinion is axially slidably mounted on the rotary shaft, and a rotational force is transmitted from the clutch inner member to the pinion through the helical splines. The pinion may also have formed at its rear portion a flange having an outer diameter larger than a diameter of an opening in the front end of the front housing. Further, the front end of the clutch inner member and the rear end surface of the pinion may be arranged to abut against each other when the pinion is disengaged from an engine ring gear, and the armature rotary shaft in front of the pinion is covered by a cover.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
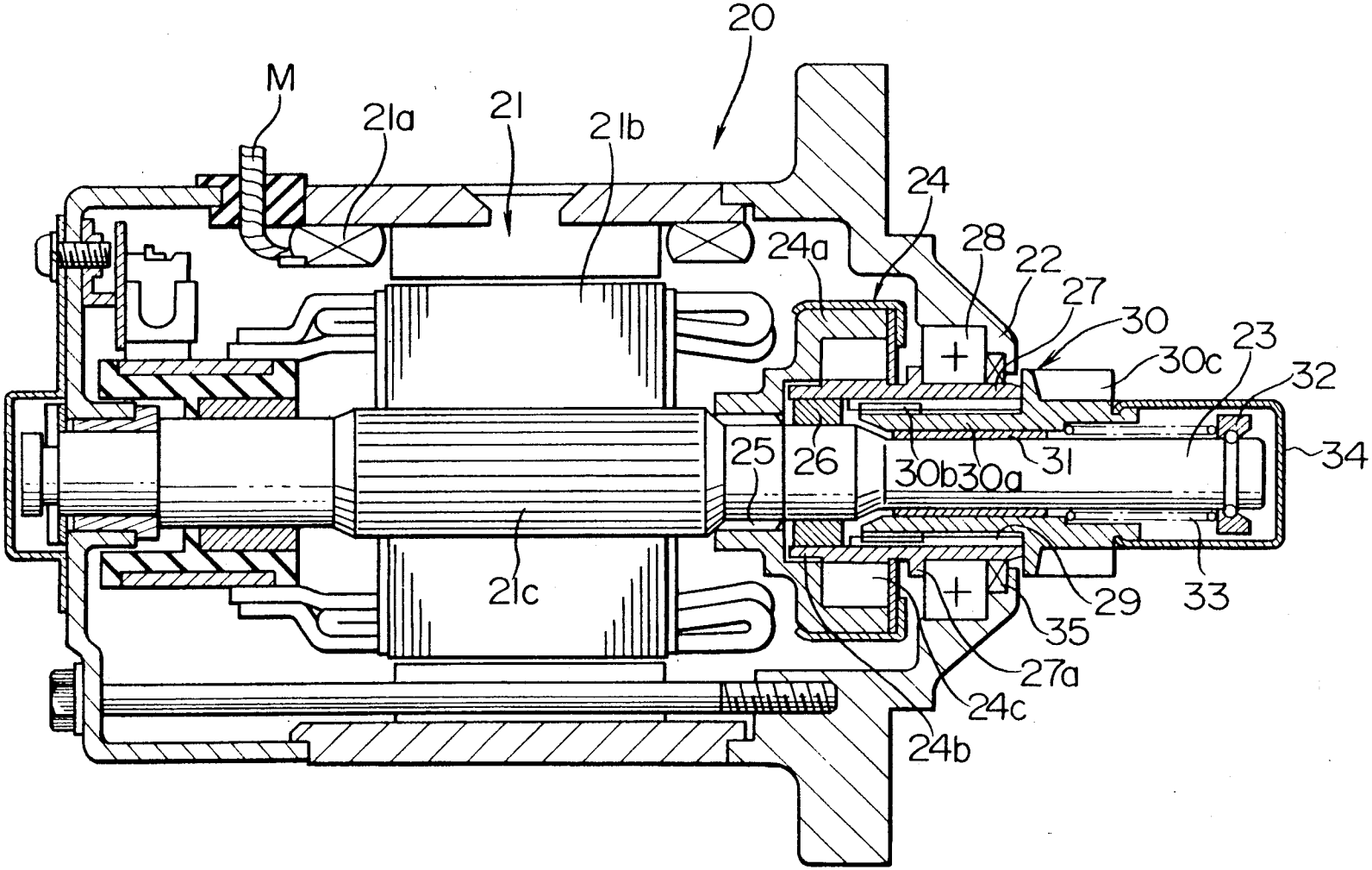
FIG. 1 is a sectional view showing an inertia sliding type starter motor of one embodiment of the present invention.

FIG. 1 illustrates an inertial sliding type engine starter motor 20 of one embodiment of the present invention. The engine starter motor 20 comprises an electric motor 21 having a field coil 21*a* and an armature 21*b* including an armature rotary shaft 21*c*. The armature rotary shaft 21*c* extends forward (to the right as viewed in FIG. 1) through a front housing 22 to provide a support shaft 23 integral with the armature rotary shaft 21*c*.

On the support shaft 23, an over-running clutch 24 is coaxially disposed within the interior of the front housing 22. The hub portion of the clutch outer member 24*a* of the over-running clutch 24 engages straight splines 25 formed in the armature shaft 21*c* in the position adjacent to the armature 21*b*, and a bearing 26 is disposed between the clutch inner member 24*b* and the support shaft 23. From the front end of the clutch inner member 24*b*, a cylindrical clutch support member 27 integrally extends in the axial direction so that the clutch support member 27 is press-fit within an inner race of a bearing 28 mounted to the front housing 22. On the outer circumference of the clutch support member 27, a radial projection 27*a* which engages the side surface of the inner race of the bearing 28 is formed partially or completely around the circumference. Thus, the over-running clutch 24 is supported immovably in the forward and backward direction or in the axial direction by the engagement between the projection 27*a* and the bearing 28 as well as the engagement between the rear end of the hub of the clutch outer member 24*a* and the step of the support shaft 23.

Helical splines 29 are formed in the axially continuous surface of the inner circumference of the clutch support member 27 integral with the clutch inner member 24*b*. The helical splines 29 are engaged by teeth 30*b* formed in the outer circumference of the rear end of the cylindrical portion 30*a* of a tubular pinion movement member or shaft 30 inserted into the inner circumference of the clutch inner member 24*b*. A sleeve bearing 31 is fitted in the inner circumference of the pinion movement member 30, whereby the pinion movement member 30 is slidably and rotatably supported on the support shaft 23. A pinion 30*c* of the pinion movement member 30 is integrally formed on the front end of the cylindrical portion 30*a* and is positioned outside of the front housing 22.

In FIG. 1, reference numeral 32 is a stopper mounted to the front end of the support shaft 23, 33 is a return spring disposed between the stopper 32 and an enlarged-diameter step portion of the inner circumference of the pinion 30*b*, 34 is a cap mounted on the front end of the pinion 30*b* and enclosing the end portion of the support shaft 23 projecting forward from the pinion 30*c*, and 35 is an oil seal disposed between an opening portion of the front housing 22 and the outer circumference of the clutch support member 27.

Figure 7:
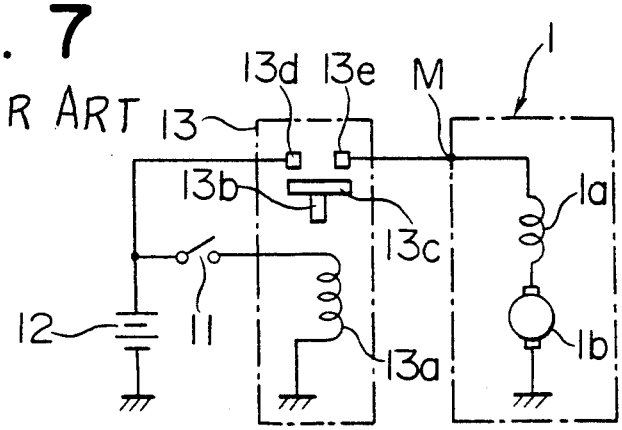
FIG. 7 PRIOR ART
FIG. 7 is a circuit diagram of the conventional engine starter motor shown in FIG. 6.

The operation of the engine starter motor 20 of the above embodiment will now be described. Since the circuit arrangement up to the power supply terminal M and the operation of the solenoid switch are the same as those of the conventional design shown in FIG. 7, their description will be omitted.

When a power from the battery is applied to the power supply terminal M, an electric current flows through the field coil 21*a* and the coil of the armature 21*b* to start the rotation of the armature 21*b*. This rotation of the armature rotary shaft 21*c* is transmitted to the clutch outer member 24*a* of the one-way clutch 24 through the straight splines 25 and at the same time to the clutch inner member 24*b* through the rollers 24*c*. The rotation of the clutch inner member 24*b* causes the pinion movement member 30 to move forward on the support shaft 23 against the action of the return spring 33 due to the inclination angle of the helical splines 29 formed in the inner circumferential surface of the clutch inner member 24*b* and the inertia of the pinion movement member 30, whereby the pinion 30*c* engages with the engine ring gear to rotate it and start the engine. When the key switch is turned off after the engine has been started, the pinion movement member 30 returns to its original position shown in FIG. 1 by the action of the return spring 33.

According to the above embodiment, since the pinion movement member 30 alone is slidable on the support shaft 23 and the over-running clutch 24 is axially immovable, the mechanical impact generated between the pinion 30*c* and the engine ring gear at the initial stage of the engagement is very small, so that the pinion 30*c* and the engine ring gear can be prevented from being damaged.

Figure 6:
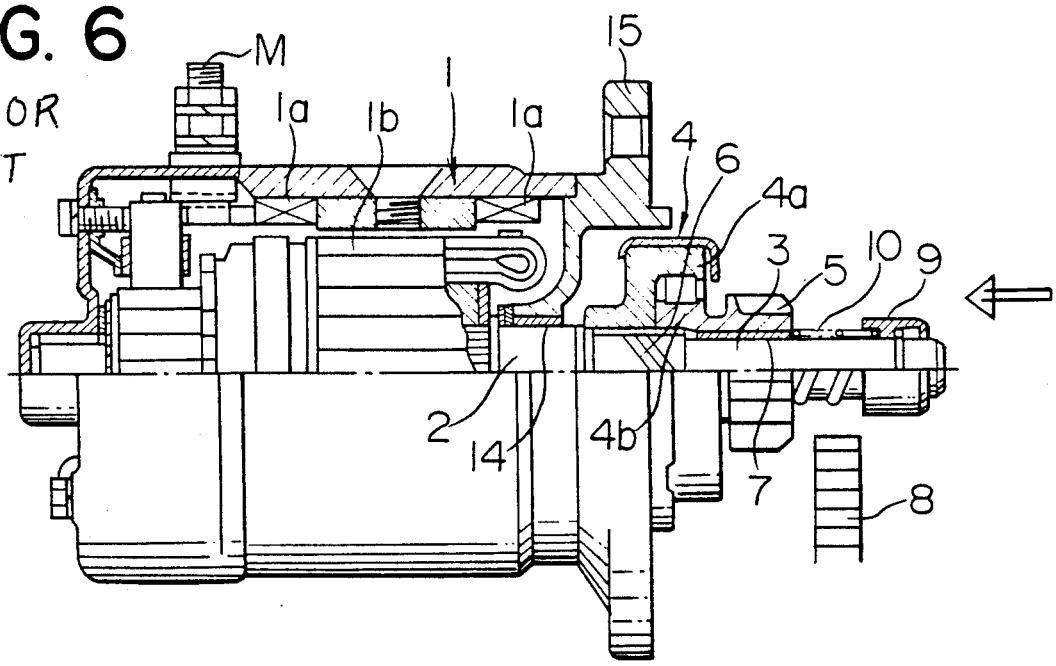
FIG. 6 PRIOR ART
FIG. 6 is a sectional view showing a conventional engine starter motor.

Also in this embodiment, the over-running clutch 24 is supported substantially by the front frame 22 through the bearing 28 by the clutch support member 27, so that the load thereon is not directly applied to the support shaft 23. Also, since the distance between the pinion 30*c* and the bearing 26 for the support shaft 23 can be made shorter than that of the conventional design shown in FIG. 6, the bending moment of the support shaft 23 is significantly reduced, whereby the bending of and the damage to the support shaft can be prevented.

Further, according to this embodiment, the over-running clutch 24 is disposed inside of the front housing 22, and the ingress of water or dust into the interior of the front housing 22 is prevented by the bearing 28 disposed between the front housing 22 and the outer circumferential surface of the clutch support member 27 supporting the over-running clutch 24 and the oil seal 35 disposed axially adjacent to the front end of the bearing 28, so that the malfunctioning of the over-running clutch 24 can be prevented and the generation of rust in various portions of the electric motor 21 can be prevented.

Figure 2:
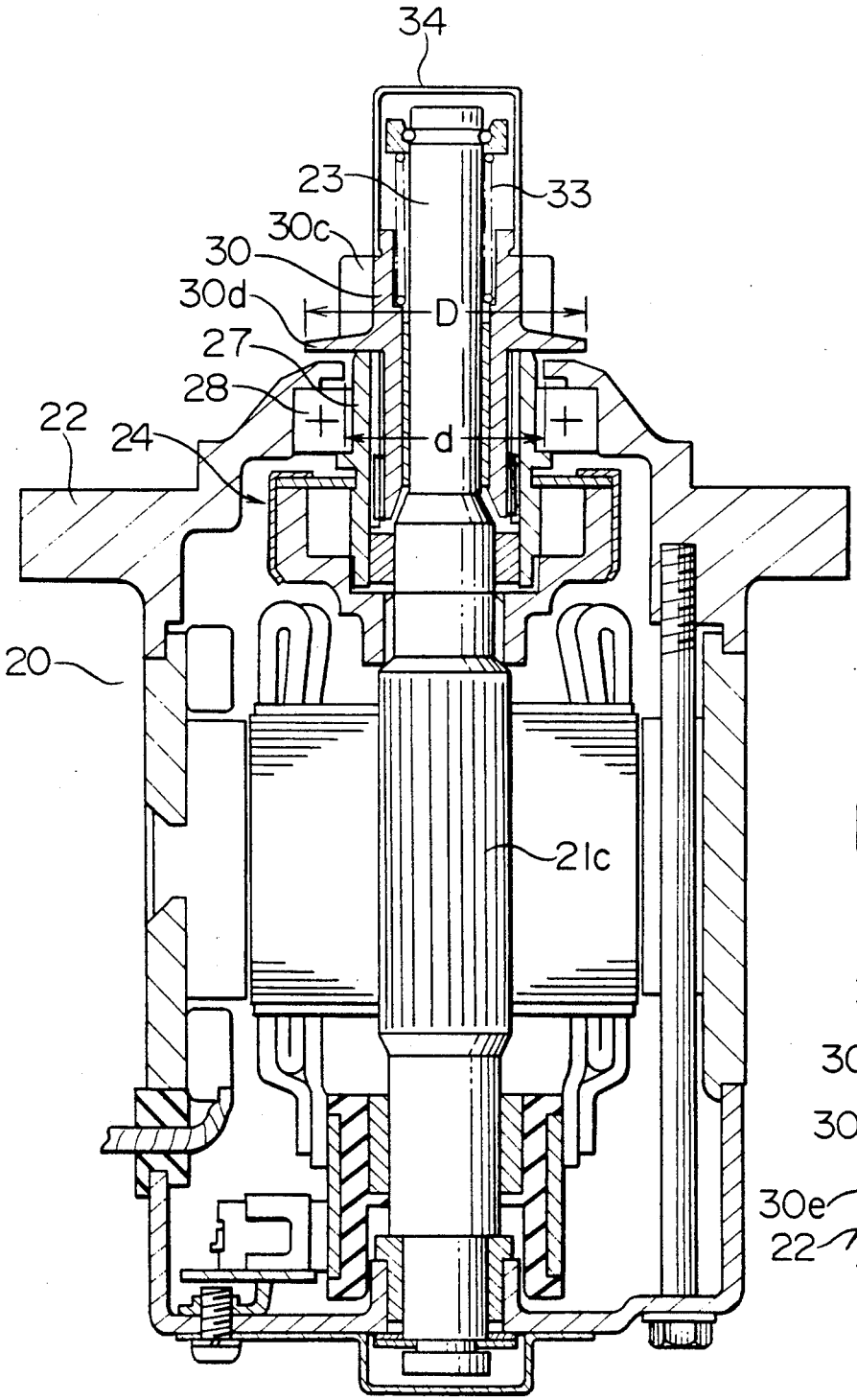
FIG. 2 is a sectional view showing an engine starter motor of another embodiment of the present invention.

FIG. 2 illustrates another embodiment of the present invention, in which a flange 30*d* radially extending from the rear end of the pinion 30*c* is formed. The outer diameter D of the flange 30*d* is larger than the diameter d of the opening in the front end of the front housing 22. That is, the flange 30*d* substantially closes a clearance between the clutch support member 27 of the over-running clutch and the front housing 22. In other respects, the arrangement is similar to that shown in FIG. 1 and the description thereof is omitted.

According to this embodiment in which the flange 30*d* formed on the pinion 30*c* covers the clearance between the clutch support member 27 of the over-running clutch and the front housing 22, even when the water falls on the starter motor from above, the water flows on the flange 30*d* therealong and along the side portion of the front housing 22 and can be exhausted to the exterior, whereby the ingress of the water into the starter motor through the clearance formed betweeen the clutch support member 27 and the front housing 22 can be prevented.

Figure 3:
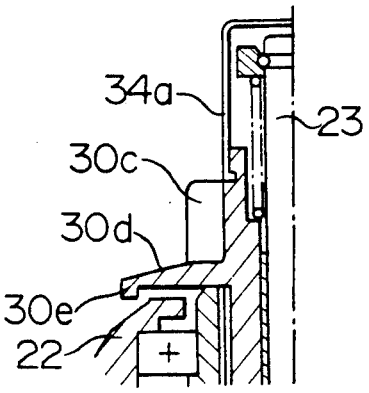
FIG. 3 is a sectional view showing a modification of the engine starter motor shown in FIG. 2.

As shown in FIG. 3, the flange 30*d* formed on the pinion 30*c* may have a downturned edge 30*e* extending toward the front housing 22 from the outer periphery of the flange 30*d*. This arrangement further ensures that no water splashed on the starter motor enters into the starter motor through the clearance between the clutch support member 27 and the front housing 22.

Figure 4:
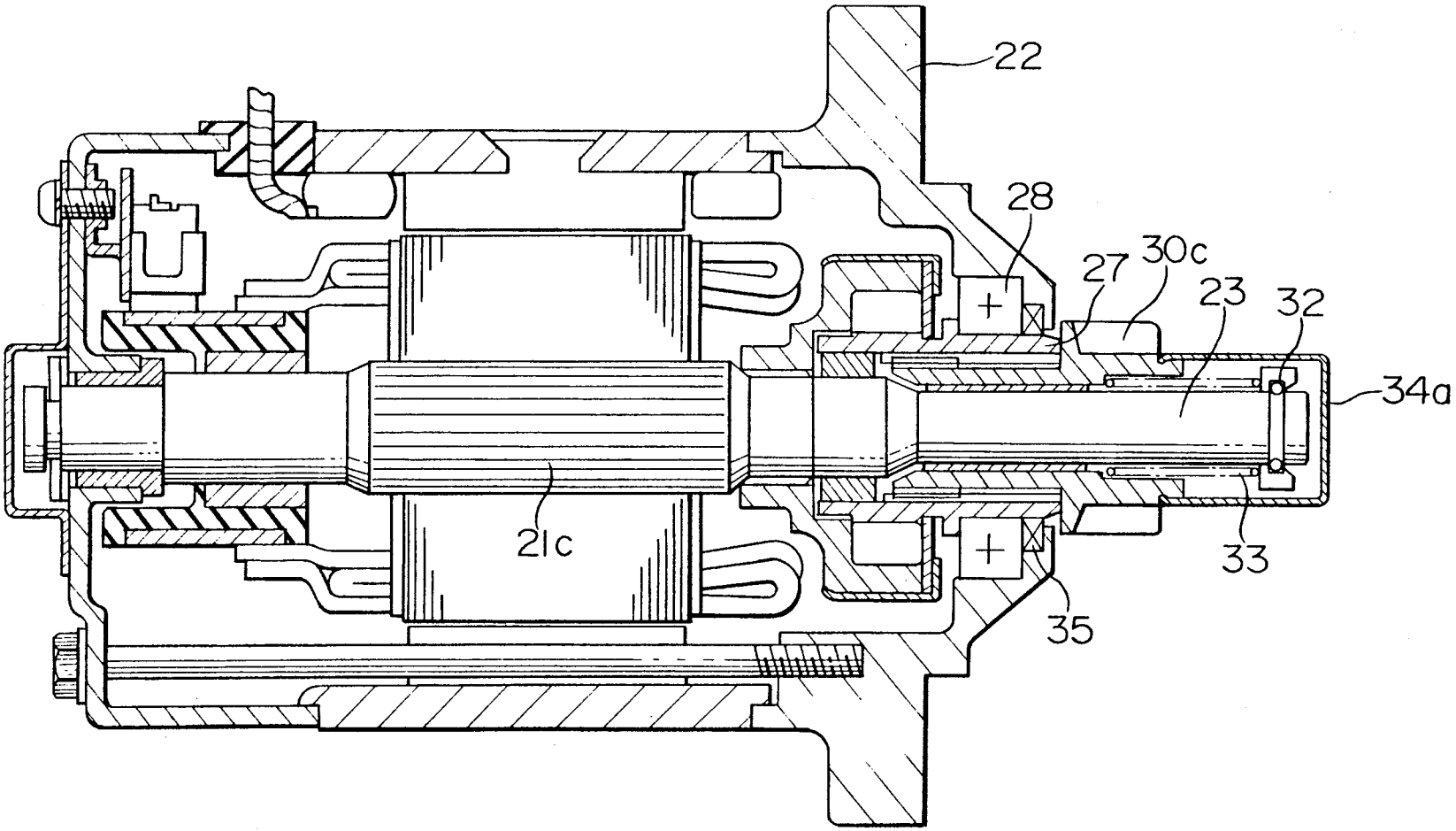
FIG. 4 is a sectional view showing an engine starter motor of another embodiment of the present invention.

FIG. 4 illustrates another embodiment of the present invention. Reference numeral 34*a* is a cover for preventing dust or water entry and it covers the front portion of the support shaft 23 in front of the pinion 30*c*, the return spring 33 and the stopper 32. 35 is an oil seal mounted to the front housing 22 so as to contact with the front end face of the bearing 28 and with the outer circumferential surface of the clutch support member 27. According to this embodiment, the rear end surface of the pinion 30*c* is in abutment with the front end of the clutch support member 27 when the pinion 30*c* is in its retracted position and disengaged from the engine ring gear. Therefore, the starter motor has no clearance which communicates the interior and the exterior thereof, preventing the ingress of water into the starter motor. Also, since the portion of the support shaft in front of the pinion 30*c* is covered by a cover 34*a*, the rusting of the support shaft 23 and the return spring 33 due to ingress of moisture is prevented, ensuring constant, smooth sliding movement of the pinion 30*c*.

While the clutch outer member 24*a* is connected to the straight splines 25 formed in the end portion of the armature rotary shaft 21*c* in the above embodiment, the clutch outer member 24*a* may be integrally formed with the armature rotary shaft 21*c* or securely mounted by a key or screws as long as the rotation of the armature rotary shaft 21*c* can be transmitted to the clutch outer member 24*a*.

Figure 5:
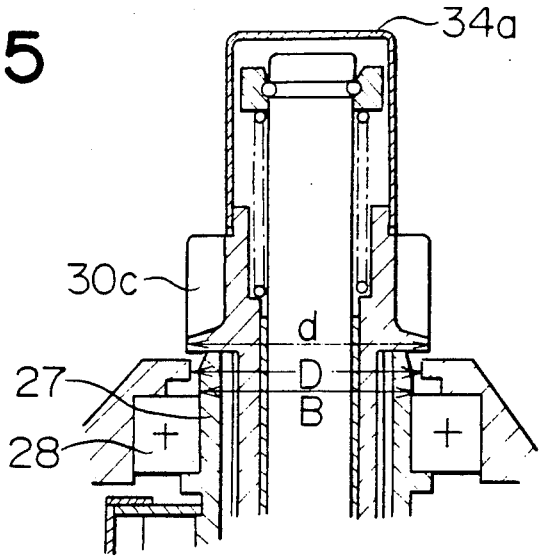
FIG. 5 is a sectional view showing a modification of the engine starter motor shown in FIG. 4.

FIG. 5 shows another embodiment in which no oil seal such as the oil seal 35 disposed between the front housing 22 and the bearing 28 in the embodiment shown in FIG. 4 is provided. This is because there is no fear that water enters into the starter motor when the outer diameter d of the rear end of the pinion 30*c* is larger than the inner diameter B of the bearing 28 for the church support member 27 and the diameter D of the front opening of the front housing 22.

Preferably, the bearing 28 is a ball bearing rather than a sleeve bearing because it is desirable to make the clearance between the bearing and the clutch support member 27 close to zero. Also, when the oil seal is not used between the front housing 22 and the bearing 28, a sealed ball bearing is preferable. A further rust-proof effect can be obtained by selecting a stainless steel material for the clutch support member 27 and the ball bearing. Also the electric motor 21 may be of the permanent magnet type.

As has been described, according to the inertia sliding type engine starter motor of the present invention, a clutch inner member of an over-running clutch rotatable with an armature shaft which is coupled to an inner member of the over-running clutch through rollers is axially forwardly immovably supported by a bearing mounted to a front housing, the clutch inner member has helical splines formed in its inner circumference, the pinion is axially slidably mounted on the rotary shaft, and a rotational force is transmitted from the clutch inner member to the pinion through the helical splines. Therefore, mechanical impact at the initial stage of the engagement between the pinion and the engine ring gear can be significantly reduced, enabling the damage of the pinion and the ring gear as well as the support shaft to be prevented.

Also, according to another embodiment of the engine starter motor of the present invention, the pinion has formed at its rear portion a flange having an outer diameter larger than a diameter of an opening in the front end of the front housing. Therefore, no water can enter into the starter motor through the clearance between th pinion and the front housing, preventing faults of the electric motor and resulting in a reliable starter motor.

Further, according to still another embodiment of the engine starter motor of the present invention, the front end of the clutch inner member and the rear end surface of the pinion abut with each other when the pinion is out of engagement with an engine ring gear, and the armature rotary shaft in front of the pinion is covered by a cover. Therefore, there is no clearance or gap in the starter motor which allows water to enter therethrough and the front portion of the support shaft and the return spring thereon are protected from rust due to moisture, ensuring a smooth and reliable sliding operation of the pinion.

What is claimed is:

1. An engine starter apparatus, comprising:

(a) an electric motor having a rotary armature shaft (21*c*) including an integral, outwardly extending support shaft (23), (b) an over-running clutch (24) coaxially surrounding the support shaft and including:

(1) a clutch outer member (24*a*) coupled to the support shaft by straight spline means (25) for rotation therewith, (2) a tubular clutch inner member (24*b*, 27) driven by the clutch outer member, coaxially surrounding the support shaft, and having a first helical splines (29) formed on an inner surface thereof, (c) a tubular pinion (30) having a pinion gear (30*c*) integrally formed on an outermost end thereof, and disposed in an annular space defined between the support shaft and the clutch inner member, the pinion shaft having a second helical splines formed on an outer surface meshing with the first helical splines, (d) first bearing means (31) disposed between the support shaft and an inner surface of the pinion shaft for rotatably and slidably supporting the pinion shaft.

(e) second bearing means (28) coaxially surrounding the first bearing means and disposed between an outer surface of the clutch inner member and a front housing (22) of the motor for rotatably supporting the clutch inner member, and (f) means (27*a*) for restraining the clutch against axial movement.

2. An engine starter apparatus as claimed in claim 1, further comprising a pinion shaft return spring (33) disposed surrounding an outermost end of the support shaft, and a cup-shaped cap member (34) secured to an outermost end of the pinion shaft and enclosing the outermost end of the support shaft and the return spring.

* * * * *